US012807363B2

(12) United States Patent
Magner

(10) Patent No.: US 12,807,363 B2
(45) Date of Patent: Nov. 24, 2026

(54) DISPOSABLE BOX WITH FOLD-FORWARD PANEL THAT SAVES MATERIAL

(71) Applicant: Peter Magner, East Sandwich, MA (US)

(72) Inventor: Peter Magner, East Sandwich, MA (US)

( * ) Notice: Subject to any disclaimer, the term of this patent is extended or adjusted under 35 U.S.C. 154(b) by 296 days.

(21) Appl. No.: 18/637,267

(22) Filed: Apr. 16, 2024

(65) Prior Publication Data

US 2025/0320018 A1 Oct. 16, 2025

(51) Int. Cl.
*B65D 5/02* (2006.01)
*B65D 25/54* (2006.01)

(52) U.S. Cl.
CPC ..... *B65D 5/02* (2013.01); *B65D 25/54* (2013.01); *B65D 2301/10* (2013.01)

(58) Field of Classification Search
CPC ..... B65D 5/02; B65D 25/54; B65D 2301/10; B65D 5/4204; B65D 5/6667; B65D 2585/366; B65D 5/6664; B65D 5/0005; B65D 5/5455; B65D 5/546; B65D 85/36; B65D 2401/15; B65D 2581/3406; B65D 5/42; B65D 5/5425; Y02W 30/80; B31B 2120/102; B31B 50/00; B31B 50/14; B31B 50/83; B32B 2307/412; B32B 2439/62; B32B 2439/70; B32B 38/0004
USPC ..... 229/141, 101.2, 120, 120.13, 125, 906, 229/903, 240, 237, 232, 128; 426/122; 493/59
See application file for complete search history.

(56) References Cited

U.S. PATENT DOCUMENTS 2,948,455 A 8/1960 Frankenstein
3,342,399 A 9/1967 Reynolds
(Continued)

FOREIGN PATENT DOCUMENTS

CN 210556120 U 5/2020
EP 2199223 B1 3/2014
WO 2010020815 A2 2/2010

OTHER PUBLICATIONS

Author: aliexpress.us Title: Kraft Paper Bow Gift Box Packaging Baking White Cake Box Christmas Decor 2021 Wedding Gift Cardboard Boxes Party Supplies Website: https://www.bing.com/search?pglt=299&q=Kraft+Paper+Bow+Gift+Box+Packaging+Baking+White+Cake+Box+Christmas+Decor+2021+Wedding+Gift+Cardboard+Boxes+Party.
(Continued)

*Primary Examiner* — Christopher R Demeree
(74) *Attorney, Agent, or Firm* — Russ Weinzimmer & Associates, PC

(57) ABSTRACT

A disposable box with a material-saving feature: a panel cut into a top portion of the box that can be hingedly folded forward to close the box. A hole in the top portion is created by separating the panel from the top portion along a perforated line, and then folding the panel forward. A clear plastic window that can be attached to the underside of the top portion to seal the hole is revealed when the panel is folded forward. Thus, the disposable box includes: a bottom portion, and a shorter top portion hinged to the bottom portion. When the pre-cut panel in the top portion is hingedly folded forward along a pre-fold crease line, the panel extends the top portion, thereby closing the box, while leaving a hole in the top portion that can be sealed by a clear plastic window attached to the underside of the top portion.

12 Claims, 9 Drawing Sheets

(56) References Cited

U.S. PATENT DOCUMENTS

| | | | | |
|---|---|---|---|---|
| 4,836,383 | A * | 6/1989 | Gordon | B65D 5/48014 219/730 |
| 5,358,176 | A * | 10/1994 | Rigby | B65D 5/5455 229/227 |
| 7,681,782 | B2 | 3/2010 | Bondarik | |
| 8,523,049 | B2 | 9/2013 | Fitzwater | |
| 8,857,702 | B2 | 10/2014 | Hui | |
| 10,351,294 | B2 * | 7/2019 | Huffer | B23K 26/0846 |
| 11,952,182 | B2 * | 4/2024 | Forsberg | B65D 5/2052 |
| 2006/0180645 | A1 | 8/2006 | Takagi et al. | |
| 2007/0023436 | A1 | 2/2007 | Sierra-Gomez et al. | |
| 2011/0114712 | A1 | 5/2011 | Malo et al. | |
| 2011/0155796 | A1 | 6/2011 | Moore | |
| 2011/0174643 | A1 | 7/2011 | Pookrum | |
| 2012/0031958 | A1 | 2/2012 | St. John et al. | |
| 2013/0068830 | A1 * | 3/2013 | Colon | B65D 5/6664 229/101.2 |
| 2014/0084046 | A1 * | 3/2014 | Colon | B65D 5/5495 493/59 |

OTHER PUBLICATIONS

Author: Howcast Title: How to Turn a Pizza Box into a Solar Oven Website: https://www.youtube.com/watch?v=xbwliZJiHe8 ATE: Downloaded Page on Feb. 12, 2021 Youtube Search_1.

* cited by examiner

DISPOSABLE BOX WITH FOLD-FORWARD PANEL THAT SAVES MATERIAL

FIELD OF THE INVENTION

This invention relates generally to disposable packaging, and more particularly to disposable packaging with reduced environmental impact.

BACKGROUND OF THE INVENTION

It is known to create pop-up pre-cut handles by pre-cutting each handle in a top or side panel of a box, thereby allowing a user to pull up each of the pre-cut handles to create a pair of handle-shaped holes, where each hole is covered underneath the hole by a clear plastic window. By pulling up the two handles, the two clear plastic windows are exposed. Thus, two handles and two openings with clear plastic windows are elegantly formed. However, the box can be used without deploying the handles, and further, no material is saved by including this feature in a box.

It is also known to make a windowed take-out container by precutting the box so that a portion can be removed by separating the portion using pre-cut perforations, thereby revealing a clear plastic window. However, this approach actually WASTES the box material of the portion that is removed to exposes the plastic window, since the portion is discarded and not used for any part of the box.

SUMMARY OF THE INVENTION

The invention is a disposable box that is configured to be cut and folded in a way that uses LESS material than a standard disposable box that is made by cutting and folding.

The invention achieves this by cutting perforations and making a pre-fold crease line to transform a panel into a top portion of the box that is shorter than a bottom portion of the box, and then separating the perforations and FOLDING the panel hingedly forward using the pre-fold crease line to cover space not covered by the shorter top portion so as to complete the box. The hole left by the panel hingedly folding forward can optionally be covered by a clear plastic window. Instead of a clear plastic window, one could use an opaque film, a sheet of paper, a film of translucent colored plastic, a compostable film, a biodegradable film, an edible film, or a hemicellulose film.

Thus, when the panel is folded forward, it can reveal the clear plastic window, and cover the space that was open due to the top portion of the box being shorter than the bottom portion of the box, thereby efficiently using the cardboard material of the panel to complete closure of the box. The panel is locked in place by a tab inserted in the bottom of the box, called a "tuck lock".

Likewise, in a clamshell embodiment of the invention, a clear plastic window is revealed when the panel is hingedly folded forward. Since the clamshell embodiment has pre-formed top and bottom cavities, the panel doesn't need side flaps as were included in the first embodiment.

The clamshell embodiment also includes a lock feature which conforms well to the tapered sidewall of the clamshell, and provides quick and easy releasable closure.

The lock feature can be a "tab lock", a "tuck lock", or any other suitable friction lock. The lock feature can also be a spear lock, or other mechanically latching feature. The lock feature could also be a resealable adhesive. Alternatively, the lock feature can be a tamper-evident seal.

In both embodiments, a panel cut into a top portion of the box is hingedly folded forward to complete the box to become a closed container. Folding the panel forward optionally reveals a clear plastic window already attached to the underside of the top portion of the box.

So, when the panel is folded forward, in some embodiments, the clear plastic window is exposed, and the forward-folded panel covers the gap that was open due to the top portion of the box being shorter than usual, thereby using less material.

A general aspect of the invention is a disposable box with material-saving features. The disposable box includes: a bottom portion having a bottom width, a bottom length, and a bottom depth; a top portion in hinged relationship with the bottom portion, the top portion having a top width and top depth substantially equal to the bottom width and the bottom depth, respectively, while having a top length that is substantially less than the bottom length, such that the top portion does not extend sufficiently to cover the bottom portion; and a panel cut into the top portion, the panel having a shape and size defined by a pre-fold crease line with a first end and a second end, and a line of separation beginning at the first end, and ending at the second end of the pre-fold crease line, such that when the panel is hingedly folded 180 degrees along the pre-fold crease line, the panel extends beyond the top portion so as to substantially equal the bottom length, while leaving a hole in the top portion, the hole having the shape and size of the panel.

In some embodiments, the disposable box further includes window material of a similar shape and larger size than the panel, the window material attached along a circumference of the hole in the top portion.

In some embodiments, the window material is made from one of clear plastic, clear resin, translucent paper, fiber material, PLA (poly lactic acid), translucent colored plastic, compostable film, biodegradable film, edible film, hemicellulose film.

In some embodiments, the hole in the top portion is covered by window material attached to the underside of the top portion.

In some embodiments, the top portion includes a top lock feature for releasable engagement with the bottom portion.

In some embodiments, the panel includes a panel lock feature for releasable engagement with the bottom portion.

In some embodiments, the panel includes side flaps for engagement with the bottom portion.

In some embodiments, the top portion includes side flaps for engagement with the bottom portion.

In some embodiments, the bottom portion is foldable into a pre-formed bottom cavity, and the top portion is foldable into a pre-formed top cavity.

In some embodiments, the line of separation includes at least one of: a line of perforation, a line of repeating threads, a line of complete cut.

In some embodiments, the line of separation includes at least one of: a portion of a circle, a portion of an ellipse, a portion of a polygon, an outline of at least a portion of a recognizable object.

In some embodiments, the pre-fold crease line and the line of separation are made using a cutting and creasing die.

Another general aspect of the invention is a disposable box with material-saving features. The disposable box includes: a bottom portion having a bottom width, a bottom length, and a bottom depth; a top portion in hinged relationship with the bottom portion, the top portion having a top width and top depth substantially equal to the bottom width and the bottom depth, respectively, while having a top length that is substantially less than the bottom length, such that the top portion does not extend sufficiently to cover the bottom portion; a panel cut into the top portion, the panel having a shape and size defined by a pre-fold crease line with a first end and a second end, and a line of separation beginning at the first end, and ending at the second end of the pre-fold crease line, such that when the panel is hingedly folded 180 degrees along the pre-fold crease line, the panel extends beyond the top portion so as to substantially equal the bottom length, while leaving a hole in the top portion, the hole having the shape and size of the panel; and window material of a similar shape and larger size than the panel, the window material attached along a circumference of the hole in the top portion.

In some embodiments, the window material is made from one of: clear plastic, clear resin, translucent paper, fiber material, PLA (poly lactic acid), translucent colored plastic, compostable film, biodegradable film, edible film, hemicellulose film.

In some embodiments, the hole in the top portion is covered by window material attached to the underside of the top portion.

In some embodiments, the top portion includes a top lock feature for releasable engagement with the bottom portion.

In some embodiments, the panel includes a panel lock feature for releasable engagement with the bottom portion.

In some embodiments, the panel includes side flaps for engagement with the bottom portion.

In some embodiments, the top portion includes side flaps for engagement with the bottom portion.

In some embodiments, the bottom portion is foldable into a pre-formed bottom cavity, and the top portion is foldable into a pre-formed top cavity.

In some embodiments, the line of separation includes at least one of: a line of perforation, a line of repeating threads, a line of complete cut.

In some embodiments, the line of separation includes at least one of:

a portion of a circle, a portion of an ellipse, a portion of a polygon, an outline of at least a portion of a recognizable object.

In some embodiments, the pre-fold crease line and the line of separation are made using a cutting and creasing die.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

Figure 1:
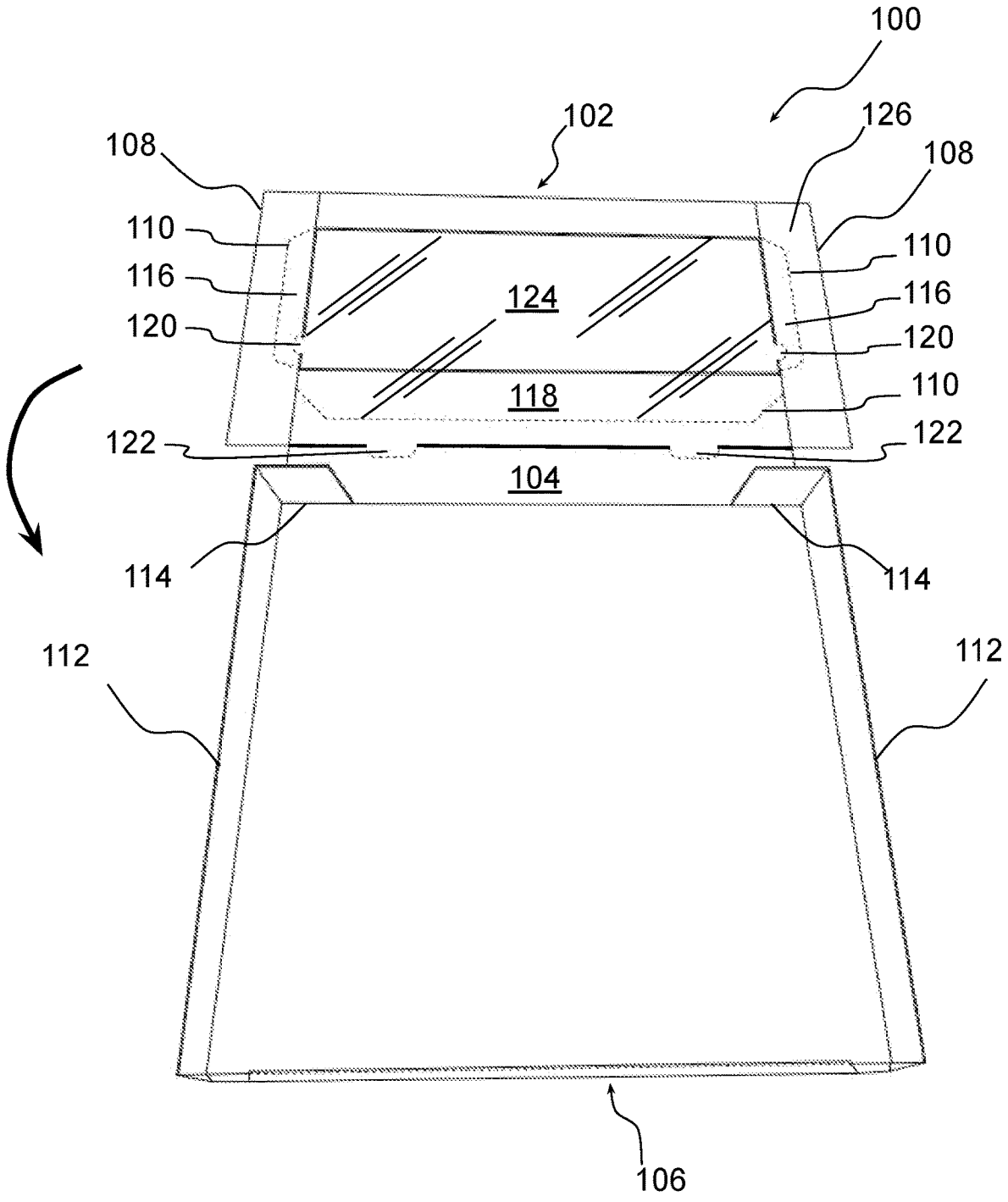
FIG. 1 is a front top perspective view of an embodiment of the disposable box, showing the bottom portion, and the top portion in open hinged relationship with the bottom portion, the top portion having a length that is substantially less than the length of the bottom portion, also showing a panel cut into the top portion.

Referring to FIG. 1, an embodiment 100 of the disposable box of the invention is shown. The embodiment 100 is in an unfolded state, with the top portion 102 of the embodiment 100 connected via a hinging side wall 104 to a bottom portion 106. The top portion 102 has a width substantially commensurate with the width of the bottom portion 106, while having a length that is substantially less than the length of the bottom portion 106, thereby providing a substantial savings in material as compared with typical boxes of this style.

Another notable distinction between the top portion 102 and bottom portion 106 of the embodiment 100 is that the top portion 102 is surrounded by side flaps 108 having perforations 110 and 120, while the bottom portion 106 has side walls 112 and bracers 114 which will support the hinging side wall 104 when the box is closed.

The embodiment 100 can be made from at least one of the following disposable box materials: corrugated cardboard, solid bleached sulfate (SBS), clay-coated newsback (CCNB), hemicellulose film, and recycled kraft brown paperboard, for example.

Included in top portion 102 is front securing flap 118 that is liberated by breaking the perforation line 110, while being hingedly connected to the front closing panel 124. The front closing panel 124 is liberated by breaking perforation line 110, leaving finger tabs 120 extending from the front closing panel 124 and secondary side flaps 116 that are hingedly connected to the front closing panel 124.

Note that a window layer of transparent film 126 is secured to the top portion 102, and is shown overlaying at least the front securing flap 118 and the front closing panel 124, and is secured about the periphery of the top portion 102.

As indicated by the curved arrow to the left of the box 100, the top portion 102 hingedly folds forward with respect to the side wall 104, causing the perforated tabs 122 to break free from the side wall 104 so as to form two vent holes in the side wall 104.

Figure 2:
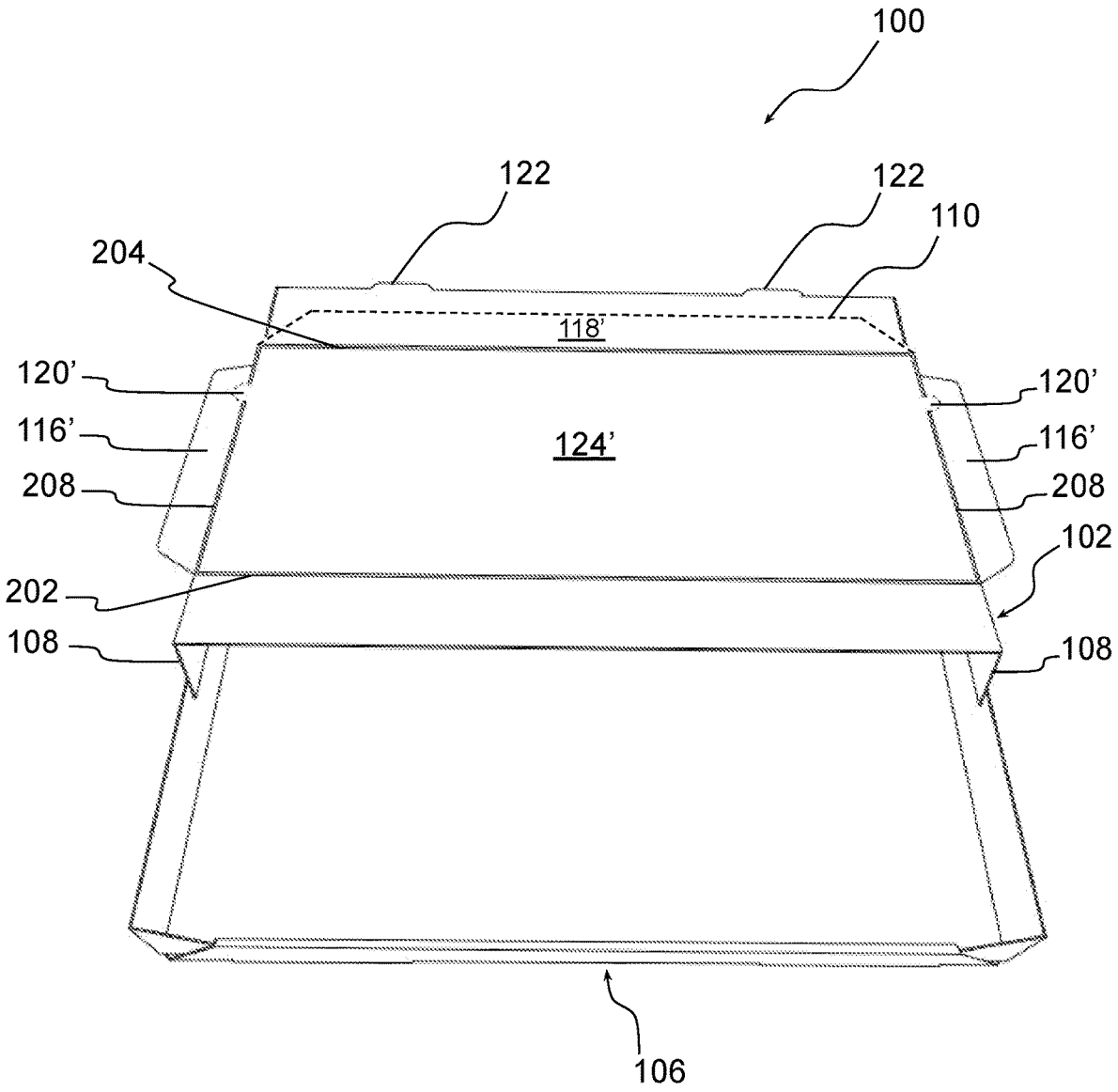
FIG. 2 is a front top perspective view of the embodiment of FIG. 1, showing the bottom portion, and the top portion in closed hinged relationship with the bottom portion, the top portion having a length that is substantially less than the length of the bottom portion, also showing the panel cut into the top portion.

With reference to FIG. 2, the embodiment 100 of FIG. 1 is again shown, now arranged with the top portion 102 hingedly folded forward about the hinging side wall 104 (FIG. 1) as a first step to closing the box embodiment 100. Readily visible in FIG. 2 is the extent of length difference between the top portion 102 and the bottom portion 106 of the embodiment 100, which further demonstrates the material savings of the invention.

The side flaps 108 of the top portion 102 have been folded downward to brace against the inner surfaces of the side walls 112 (FIG. 1) as to secure the closure of the box embodiment 100, while the secondary flaps 116 have been freed from the flaps 108 of the top portion 102 by separation along the perforations 110 (FIG. 1).

To aid in understanding, reference numbers that are primed (###') represent the opposite side of the element with the same reference number without the prime ###. For example, the secondary flaps 116 in FIG. 1 are shown as 116' in FIG. 2, because the top portion 102 was hingedly folded forward.

The front securing flap 118' is again shown in hinged relationship about pre-fold crease line 204 with the front closing panel 124', which can be hingedly folded forward about pre-fold crease line 202 to close the box embodiment 100, while revealing either an open area in the top portion 102, or a pane of transparent plastic film covering the open area, for example.

Figure 3:
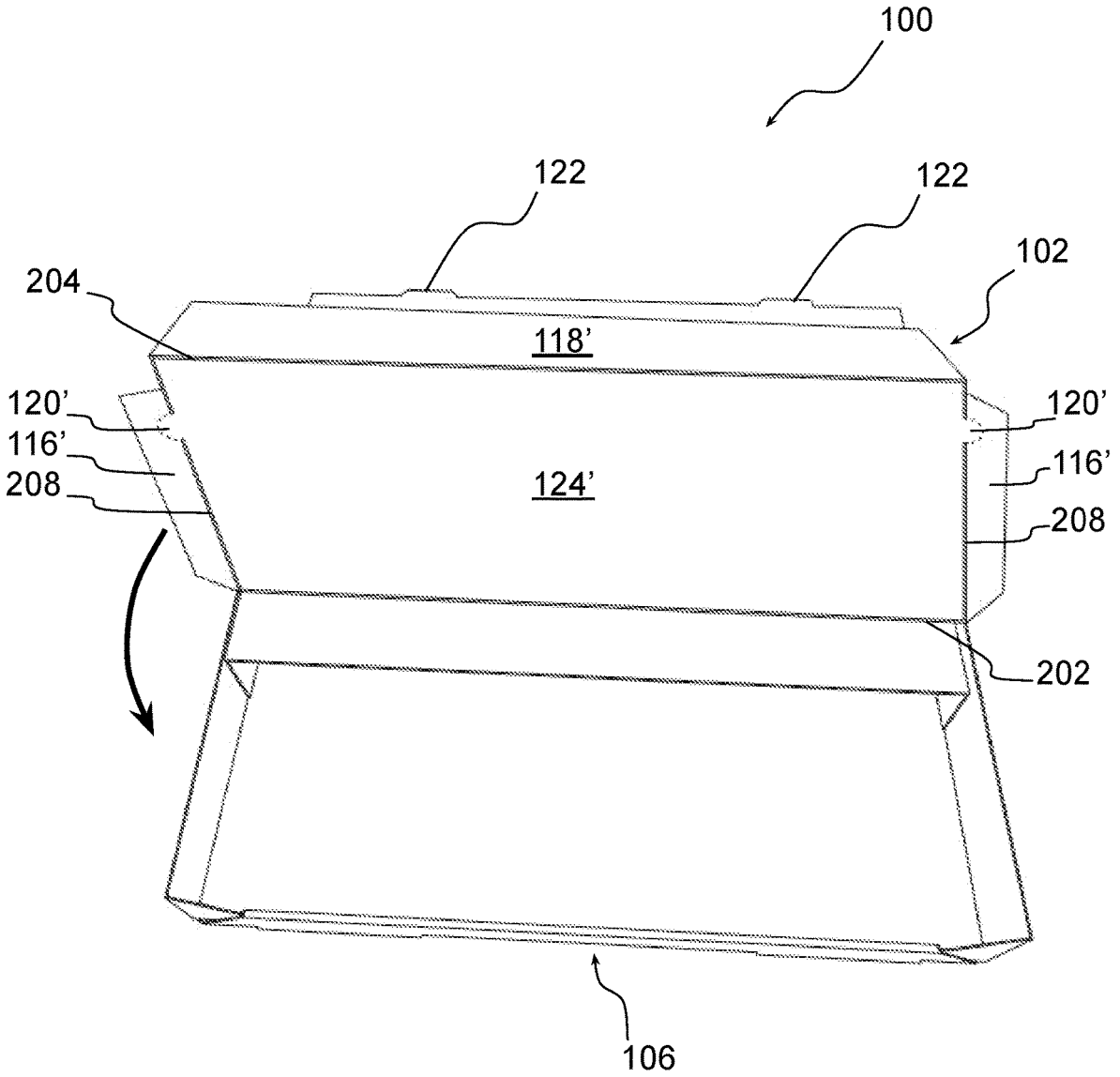
FIG. 3 is a front top perspective view of the embodiment of FIG. 1, showing the bottom portion, and the top portion in closed hinged relationship with the bottom portion, also showing the panel after being separated along three pre-cut sides from the rest of the top portion, and being hingedly folded forward along a pre-fold crease.

Referring to FIG. 3, the front closing panel 124' is shown being hingedly folded forward about pre-fold crease line 202 to close the box embodiment 100 by covering the open portion of the bottom portion 106 of the embodiment 100. The panel 124' can be made of the same material as the top portion 102 of the embodiment 100, or the top portion 102 can differ in material choice from the bottom portion 106.

Figure 4:
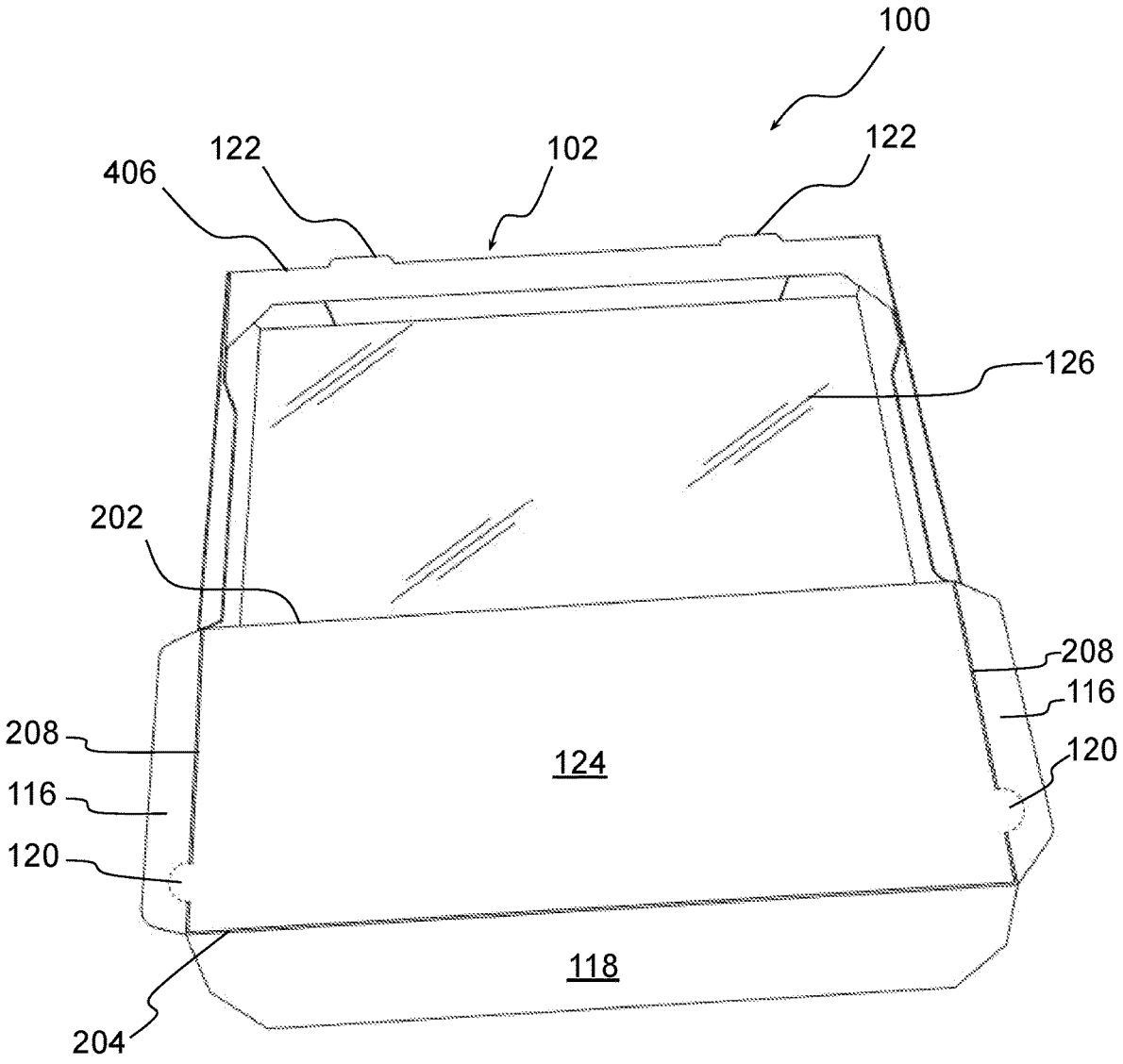
FIG. 4 is a front top perspective view of the embodiment of FIG. 1, showing the bottom portion, and the top portion in closed hinged relationship with the bottom portion, also showing the panel after being hingedly folded forward 180 degrees along the pre-fold crease line such that the panel extends beyond the top portion so as to substantially cover the bottom portion, while leaving a hole in the top portion that is the same shape and size as the panel.

With reference to FIG. 4, the front closing panel 124 is shown fully hingedly folded forward about pre-fold crease line 202, thereby covering the remaining open portion of the bottom portion 106 of the embodiment 100, and thus closing the box embodiment 100.

The two secondary flaps 116 and the front securing flap 118 that hingedly extend from the front closing panel 124 are shown, but are not yet folded downward. When the secondary flaps 116 are folded downward, the two finger tabs 120 are freed from each secondary flap 116 along a circular perforation.

The sheet of film 126 which seals the top portion 102 of the embodiment 100 over the opening created when the panel 124 was freed from the top portion 102. The film 126 used in this embodiment 100 is transparent (optional) and is shown as triple lines to suggest reflected ambient light. The opening created when the panel 124 was freed from the top portion 102 does not necessarily require a film covering.

Alternatively, instead of transparent film, paper, foil, paper, or other materials could be used. While opaque materials can be considered as possible films, common transparent or translucent films include: polypropylene (PP) film, polyethylene terephthalate (PET) film, polyvinyl chloride (PVC) film, polystyrene (PS) film, polyethylene (PE) film, cellulose film, cellophane film, and polylactic acid (PLA) film, for example. Additionally, in choosing film materials one can blend materials and can also choose materials by properties such as: color, biodegradability, edibility, and naturality, for example.

Also shown are vent tabs 122 along the pre-fold crease line 406 which connects the top portion 102 to the hinged side wall 104 (FIG. 1) of the embodiment 100.

Figure 5:
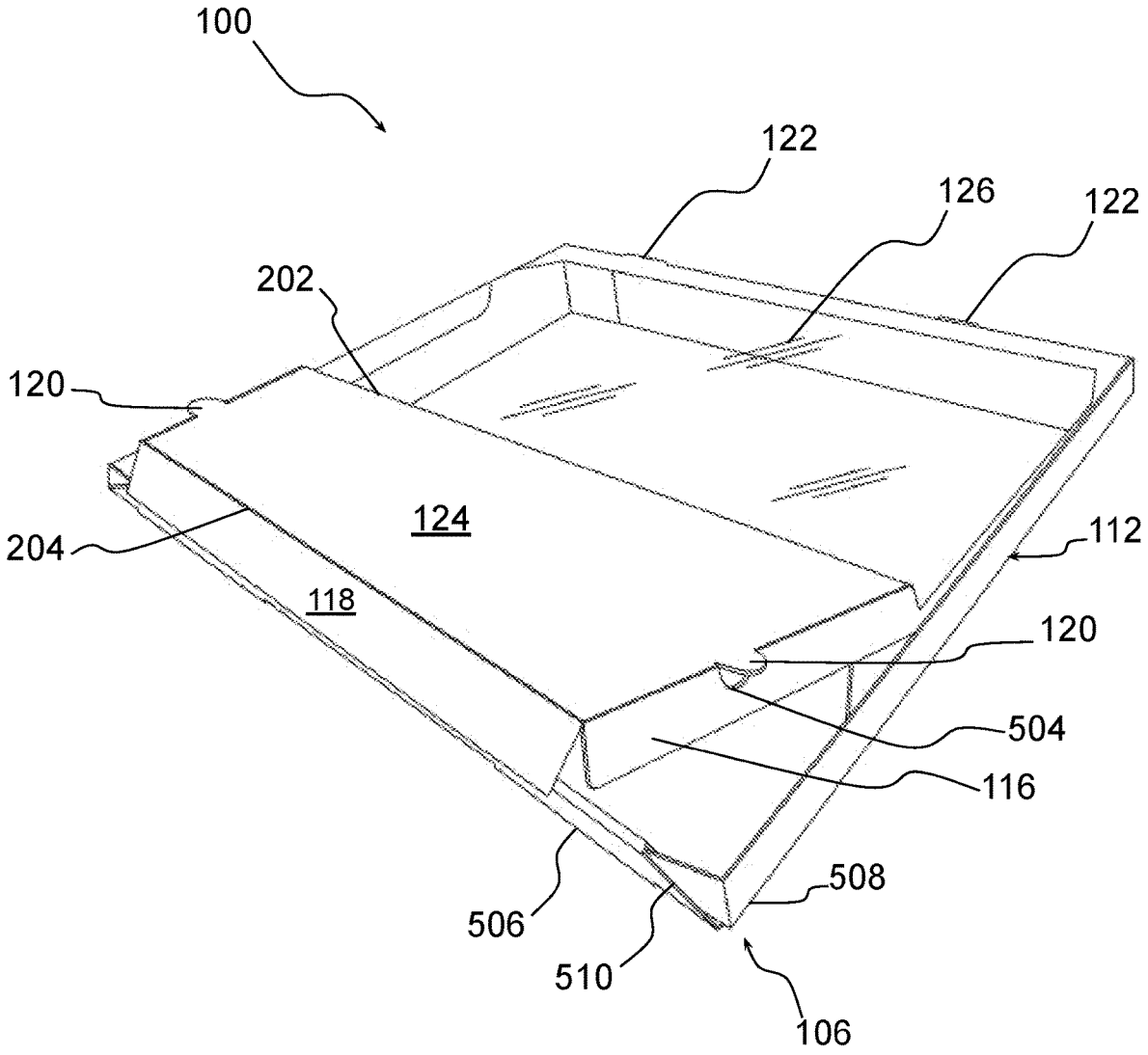
FIG. 5 is a front top right perspective view of the embodiment of FIG. 1, showing the panel after being hingedly folded forward approaching 180 degrees along the pre-fold crease, also showing the right side of the panel folded downward, exposing the right panel tab that can be used to open the disposable box, and showing the forward side of the panel partially folded downward.

Referring to FIG. 5, the embodiment 100 has been rotated for an optimized view of a secondary flap 202 and the top flap 204 as they are being folded into the side walls 112 of the bottom portion 106 of the embodiment 100. Also shown are panel tabs 502 which were freed along perforations 504 from the secondary flaps 202 of the panel 206. Perforations are only one way of enabling sections to be readily dividable, and other methods such as complete cuts can be used as well. Also revealed in this figure is the method by which the side walls 112 of the embodiment 100 are configured: the forward-facing side wall 506 is reinforced by a folding of wall material, this also creating a channel in which left and right side wall 508 protrusions 510 can be folded into. Notably, this embodiment 100 is one where a single sheet of disposable box material can be cut and creased for creating a box without the need for additional disposable box materials.

Figure 6:
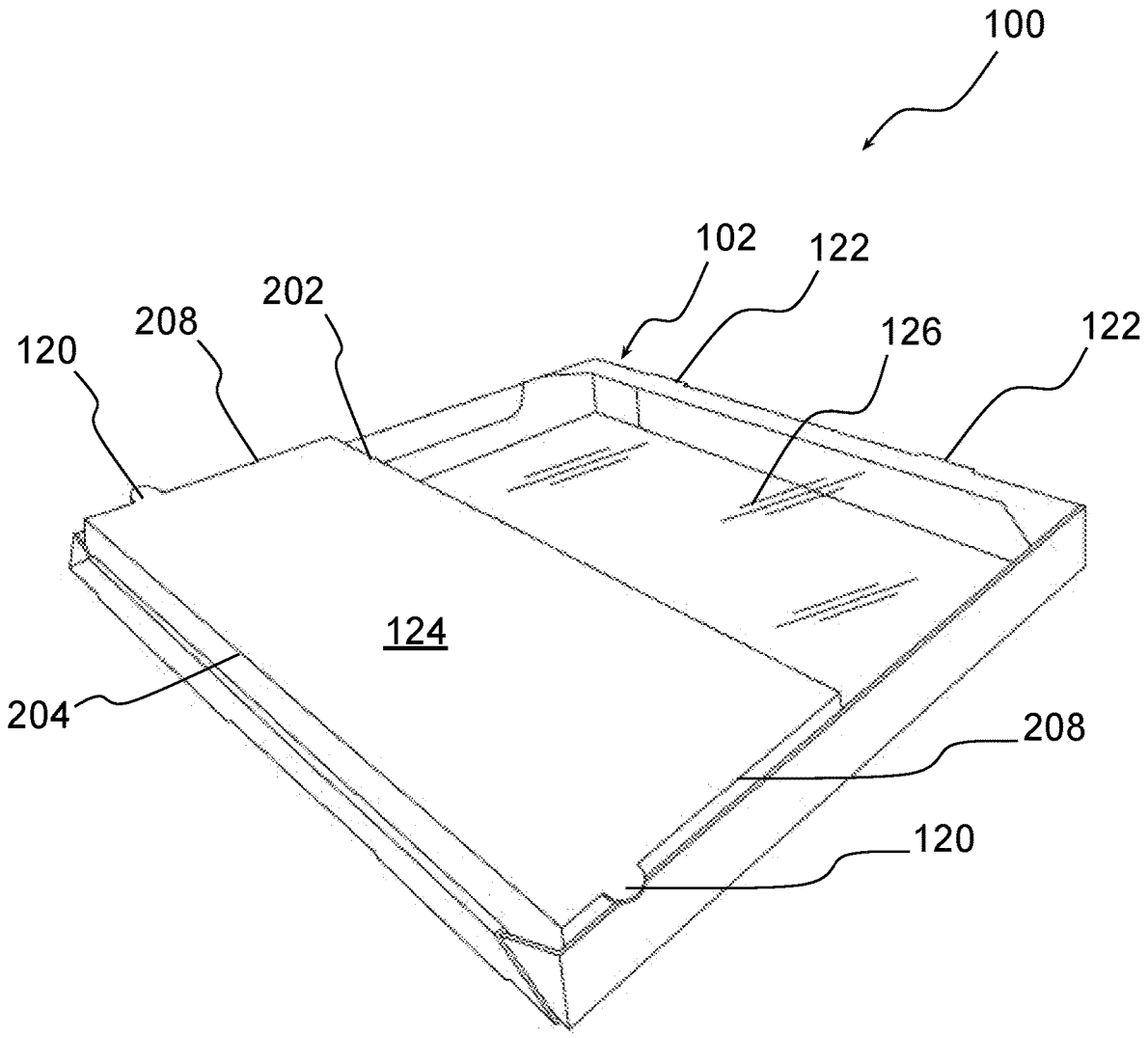
FIG. 6 is a front top right perspective view of the embodiment of FIG. 1, showing the panel after being hingedly folded forward 180 degrees along the pre-fold crease, also showing the right side of the panel folded downward and inserted into the bottom portion, the right panel tab extending outward to be used to open the disposable box, and showing the forward side of the panel folded downward and inserted into the front of the bottom portion.

With reference to FIG. 6, shows the embodiment 100 now properly and securely closed. The film 402 material lines are visible along the area of the top portion 102 which was covered by the top portion 102 before unfolding. The film 402 can be joined to the top portion 102 through the use of adhesives and heat induced adhesion, for example. While opaque materials can be considered as possible films 402, common transparent or translucent films include: polypropylene (PP) film, polyethylene terephthalate (PET) film, polyvinyl chloride (PVC) film, polystyrene (PS) film, polyethylene (PE) film, cellulose film, cellophane film, and polylactic acid (PLA) film, for example. Additionally, in choosing film 402 materials one can blend materials and can also choose materials by properties such as: color, biodegradability, edibility, and naturality, for example.

Figure 7:
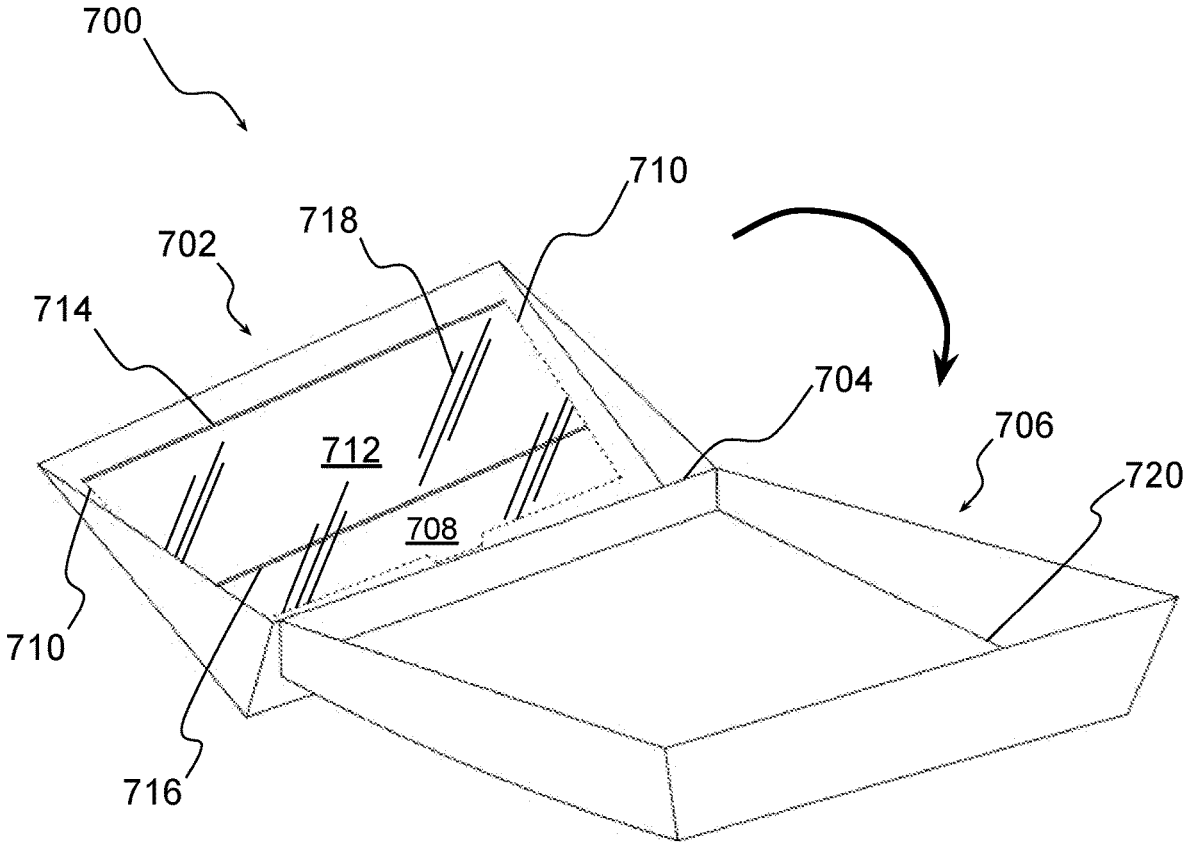
FIG. 7 is a front top left perspective view of a clam-shell embodiment of the disposable box, showing a top portion hingedly connected to a bottom portion, the top portion in an open condition, the top portion having a panel defined by three cut sides, and one pre-fold crease.

Referring to FIG. 7, a new embodiment 700 is shown in an open condition. In this embodiment 700, the top portion 702 is fluidly connected through a crease 704 to the bottom portion 706 of the embodiment 700. The crease 704 is one which conceptually divides (without physical division) the top & bottom portions (702, 706) of the embodiment 700 and the crease 704 is one which enables a hinged motion. On the top portion 702 of the embodiment 700 is a panel 708 as bounded by side perforations 710, a flap perforation 712, and a pre-fold crease 714. The clam shell shaping of the embodiment 700 underscores that no limited set of silhouettes can capture the nature of the invention as bold and custom designs are often sought in packaging industries. The disposable box material used in this embodiment is also shown to be of a thinner variety (1 mm).

Figure 8:
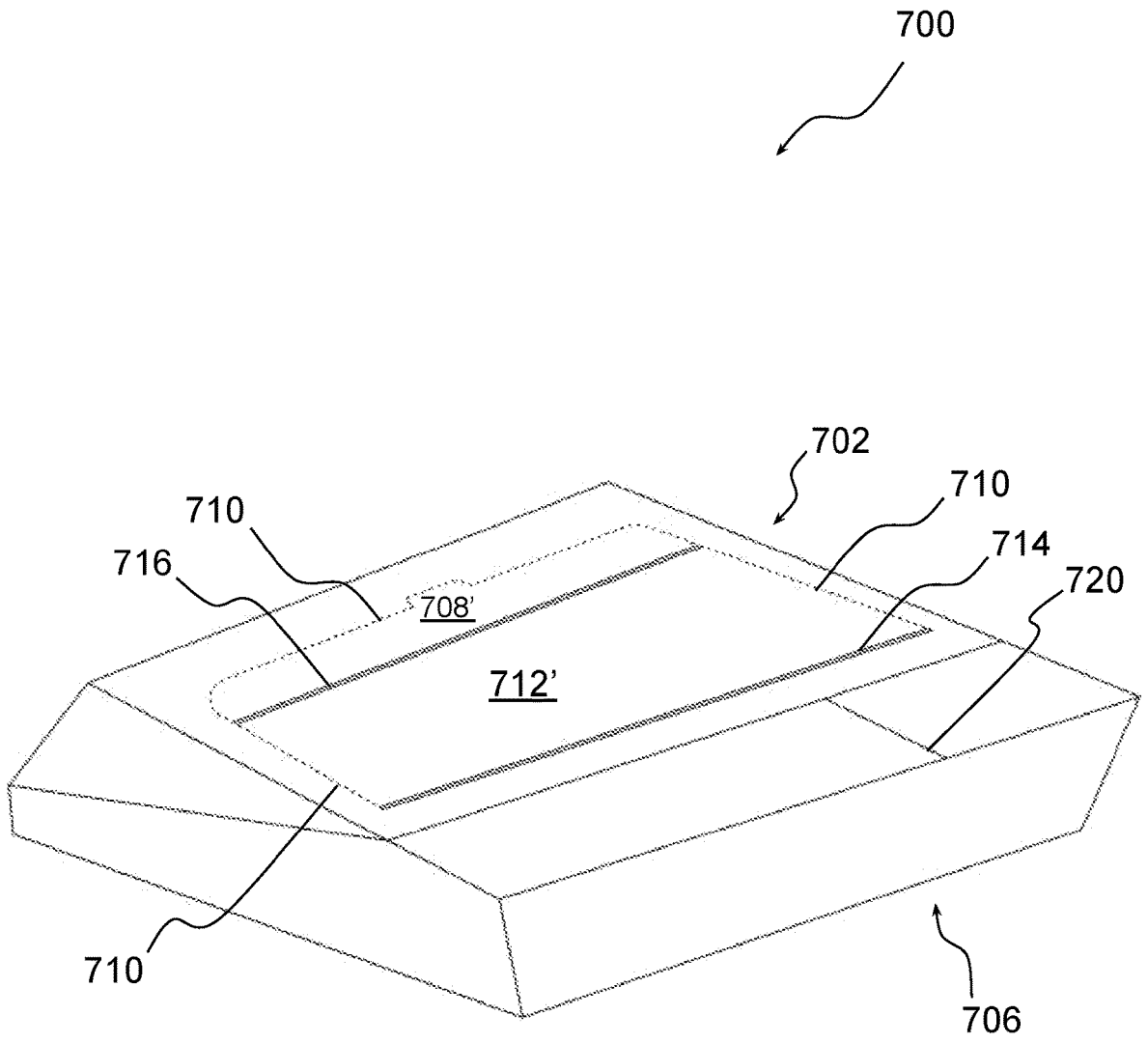
FIG. 8 is a front top left perspective view of the clam-shell embodiment of FIG. 7, showing the top portion in a closed condition only partially covering the bottom portion, the top portion having a panel defined by three cut sides, and one pre-fold crease.

With reference to FIG. 8, the embodiment 700 is now shown in a semi-closed condition such that the top portion 702 has been folded into a closed position about the crease (704; FIG. 7) of the embodiment 700. Still, the panel 708 of the embodiment 700 is not yet unfolded about its pre-fold crease 714. Similar to the pre-fold crease 714 of the panel 708 is a secondary pre-fold crease 802 which distinguishes the panel 708 from the panel's 708 front flap 804. Notably the panel's 708 front flap 804 is the only flap of this embodiment 700—this emphasizes that additional embellishments for improving properties desirable in disposable boxes (such as: ease of use and perceived quality, for example) can be added in any plurality, as is readily apparent to one skilled in the art. Readily seen as well is the notable gap caused by the reduced material requirements of the top portion 702 which is to be covered by the panel 708 of the top portion 702 when the panel 708 is unfolded.

Figure 9:
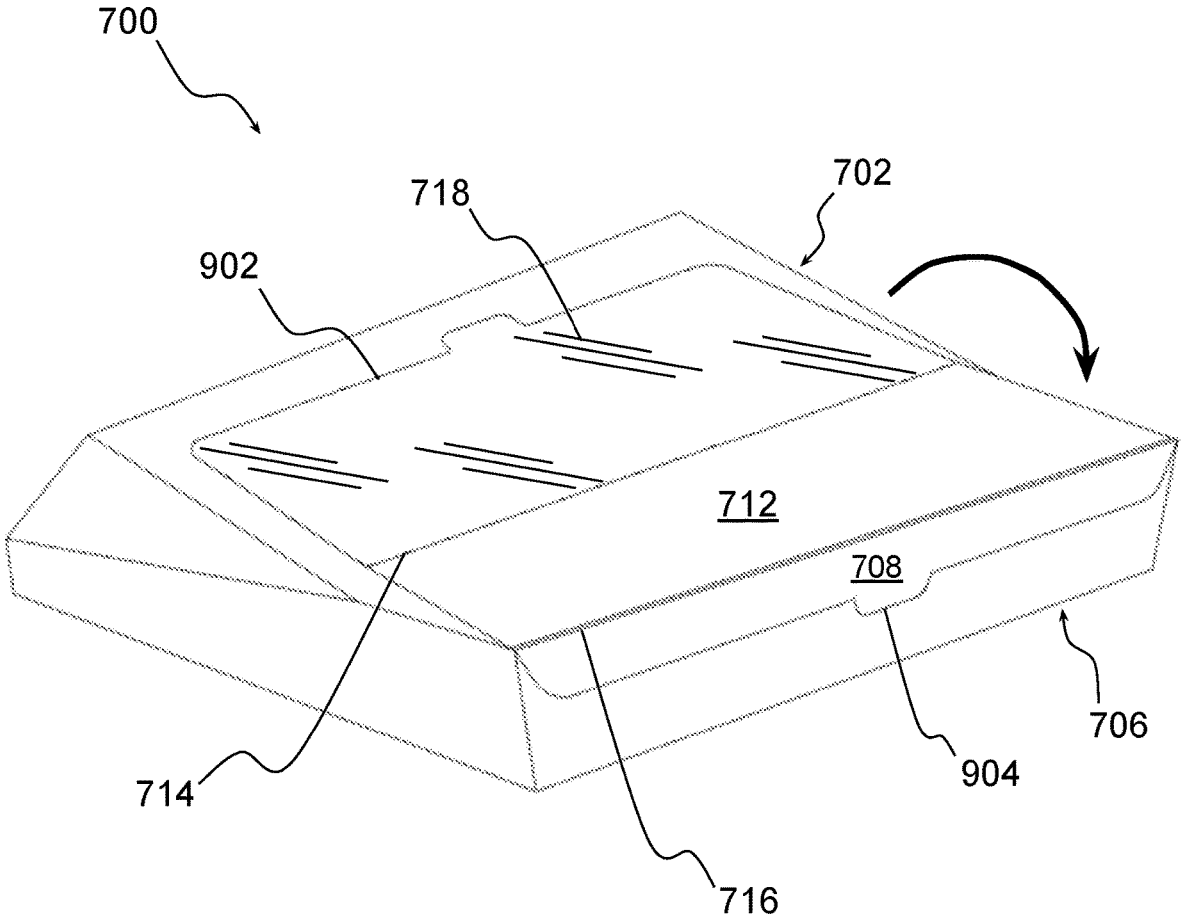
FIG. 9 is a front top left perspective view of the clam-shell embodiment of FIG. 7, showing the top portion in a closed condition, and showing the panel folded forward 180 degrees along the pre-fold crease line so as to completely cover the bottom portion, while leaving a hole in the top portion, the hole having the shape and size of the panel, the panel having a forward tab that is tucked into the bottom portion.

Referring to FIG. 9, the embodiment 700 is now shown fully closed with the pre-fold crease 714 now folded such that the panel 708 of the embodiment 700 is now unfolded and in contact with the bottom portion 706 along the secondary pre-fold crease 802 (here also folded). The front flap 804 is also shown in a secure yet untucked condition, suggesting the front flap is one which includes additional adhesion as to stick to the bottom portion 706 instead of tucking. Adhesion and tucking are only two of many possible methods by which a flap can engage a surface and others (such as: friction locks and slits which accommodate tabs, for example) can be used in any combination or plurality. This embodiment 700 is also shown to have a film 902 which is indicated to be translucent (by lack of inner structure visibility) and striped, further revealing the set of possible elements (such as: design elements, heat resistant elements, and coatings, for example) one may incorporate as part of the film to be boundless. Incorporated elements can exist in any plurality and combination, as well.

Other modifications and implementations will occur to those skilled in the art without departing from the spirit and the scope of the invention as claimed. Accordingly, the above description is not intended to limit the invention, except as indicated in the following claims.

What is claimed is:

1. A disposable box with material-saving features, the disposable box comprising:

a bottom portion having a bottom width, a bottom length, and a bottom depth;

a top portion in hinged relationship with the bottom portion, the top portion having a top width and top depth substantially equal to the bottom width and the bottom depth, respectively, while having a top length that is substantially less than the bottom length, such that the top portion does not extend sufficiently to cover the bottom portion; and a panel cut into the top portion, the panel having a shape and size defined by a pre-fold crease line with a first end and a second end, and a line of separation beginning at the first end, and ending at the second end of the pre-fold crease line, such that when the panel is hingedly folded 180 degrees along the pre-fold crease line, the panel extends beyond the top portion so as to substantially equal the bottom length, while leaving a hole in the top portion, the hole having the shape and size of the panel.

2. The disposable box of claim 1, further comprising:

window material of a similar shape and larger size than the panel, the window material attached along a circumference of the hole in the top portion.

3. The disposable box of claim 2, wherein the window material is made from one of:

clear plastic, clear resin, translucent paper, fiber material, PLA (poly lactic acid), translucent colored plastic, compostable film, biodegradable film, edible film, hemicellulose film.

4. The disposable box of claim 1, wherein the hole in the top portion is covered by window material attached to the underside of the top portion.

5. The disposable box of claim 1, wherein the top portion includes a top lock feature for releasable engagement with the bottom portion.

6. The disposable box of claim 1, wherein the panel includes a panel lock feature for releasable engagement with the bottom portion.

7. The disposable box of claim 1, wherein the panel includes side flaps for engagement with the bottom portion.

8. The disposable box of claim 1, wherein the top portion includes side flaps for engagement with the bottom portion.

9. The disposable box of claim 1, wherein the bottom portion is foldable into a pre-formed bottom cavity, and the top portion is foldable into a pre-formed top cavity.

10. The disposable box of claim 1, wherein the line of separation includes at least one of:

a line of perforation, a line of repeating threads, a line of complete cut.

11. The disposable box of claim 1, wherein the line of separation includes at least one of:

a portion of a circle, a portion of an ellipse, a portion of a polygon, an outline of at least a portion of a recognizable object.

12. The disposable box of claim 1, wherein the pre-fold crease line and the line of separation are made using a cutting and creasing die.

* * * * *